US007568251B2

(12) United States Patent
Janssen et al.

(10) Patent No.: US 7,568,251 B2
(45) Date of Patent: Aug. 4, 2009

(54) PROCESS FOR DYEING A TEXTILE WEB

(75) Inventors: Robert Allen Janssen, Alpharetta, GA (US); Thomas David Ehlert, Neenah, WI (US); John Gavin MacDonald, Decatur, GA (US); Michael Joseph Garvey, Appleton, WI (US); Patrick Sean McNichols, Hortonville, WI (US); Earl C. McCraw, Jr., Duluth, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 64 days.

(21) Appl. No.: 11/617,523

(22) Filed: Dec. 28, 2006

(65) Prior Publication Data

US 2008/0155763 A1 Jul. 3, 2008

(51) Int. Cl.
*D06B 19/00* (2006.01)

(52) U.S. Cl. ..... 8/159; 8/115.51; 8/444

(58) Field of Classification Search ..... 8/115.51, 8/543, 159, 444
See application file for complete search history.

(56) References Cited

U.S. PATENT DOCUMENTS

| | | | |
|---|---|---|---|
| 2,904,981 | A | 9/1959 | Macomson |
| 3,202,281 | A | 8/1965 | Weston |
| 3,249,453 | A | 5/1966 | Schnoring et al. |
| 3,273,631 | A | 9/1966 | Neuman |
| 3,275,787 | A | 9/1966 | Newberry |
| 3,325,348 | A | 6/1967 | Bennett |
| 3,338,992 | A | 8/1967 | Kinney |
| 3,341,394 | A | 9/1967 | Kinney |
| 3,410,116 | A | 11/1968 | Levinson |
| 3,471,248 | A | 10/1969 | Schaeuble |
| 3,484,179 | A | 12/1969 | Adams et al. |
| 3,490,584 | A | 1/1970 | Balamuth |
| 3,502,763 | A | 3/1970 | Hartman |
| 3,519,517 | A | 7/1970 | Dench |
| 3,542,615 | A | 11/1970 | Dobo et al. |
| 3,584,389 | A | 6/1971 | Hilton et al. |
| 3,620,875 | A | 11/1971 | Guglielmo, Sr, et al. |
| 3,620,876 | A | 11/1971 | Guglielmo, Sr. et al. |
| 3,653,952 | A | 4/1972 | Gagliardi |
| 3,672,066 | A | 6/1972 | Stephansen |
| 3,673,140 | A | 6/1972 | Ackerman et al. |
| 3,692,618 | A | 9/1972 | Dorschner et al. |
| 3,707,773 | A | 1/1973 | Wolfberg et al. |
| 3,762,188 | A | 10/1973 | Bernholz et al. |
| 3,782,547 | A | 1/1974 | Dietert |
| 3,802,817 | A | 4/1974 | Matsuki et al. |
| 3,829,328 | A | 8/1974 | Blustain |
| 3,849,241 | A | 11/1974 | Butin et al. |
| 3,888,715 | A | 6/1975 | Fraser et al. |
| 3,902,414 | A | 9/1975 | Zimmer |
| 3,932,129 | A | 1/1976 | Porter |
| 4,046,073 | A | 9/1977 | Mitchell et al. |
| 4,060,438 | A | 11/1977 | Johnson |
| 4,062,768 | A | 12/1977 | Elliot |
| 4,086,112 | A | 4/1978 | Porter |
| 4,131,424 | A | 12/1978 | Cocoros |
| 4,156,626 | A | 5/1979 | Souder |
| 4,210,674 | A | 7/1980 | Mitchell |
| 4,234,775 | A | 11/1980 | Wolfberg et al. |
| 4,242,091 | A | 12/1980 | Feess et al. |
| 4,274,209 | A | 6/1981 | Kawaguchi |
| 4,302,485 | A | 11/1981 | Last et al. |
| 4,339,295 | A | 7/1982 | Boretos et al. |
| 4,340,563 | A | 7/1982 | Appel et al. |
| 4,365,422 | A | 12/1982 | Kawaguchi |
| 4,379,710 | A | 4/1983 | Crounse |
| 4,393,671 | A | 7/1983 | Ito |
| 4,413,069 | A | 11/1983 | Marshall |
| 4,419,160 | A | 12/1983 | Wang et al. |

(Continued)

FOREIGN PATENT DOCUMENTS

| | | |
|---|---|---|
| DE | 2056104 | 5/1972 |
| DE | 3325958 | 2/1985 |
| DE | 4344455 | 6/1995 |
| DE | 19703634 | 10/1997 |
| DE | 29923223 | 7/2000 |
| DE | 19911683 | 9/2000 |
| DE | 19913179 | 9/2000 |
| DE | 10245201 | 4/2004 |
| DE | 10353804 | 6/2005 |
| EP | 0041779 A1 | 12/1981 |

(Continued)

OTHER PUBLICATIONS

Mathur, M. R., et al. "Energy conservation in wet processing: Development of low energy dyeing machine." Colourage Annual. 2004. pp. 93-99.*

International Search Report and Written Opinion regarding PCT/IB2007/054890, dated Apr. 18, 2008.

U.S. Appl. No. 11/530,183, filed Sep. 8, 2006, Robert Allen Janssen.

International Search Report and Written Opinion from PCT/IB2007/054903 dated Apr. 17, 2008.

(Continued)

*Primary Examiner*—Lorna M Douyon
*Assistant Examiner*—Amina Khan
(74) *Attorney, Agent, or Firm*—Armstrong Teasdale, LLP

(57) ABSTRACT

In a process for dyeing a textile web having a first face and a second face opposite the first face, dye is applied to the textile web and the dyed web is then immersed in a flowing treatment liquid with the textile web in a generally open configuration. A contact surface of an ultrasonic vibration system is immersed in the flowing treatment liquid with the contact surface in direct contact with at least a portion of the textile web immersed in the treatment liquid. The ultrasonic vibration system is operated to impart ultrasonic energy to the portion of the textile web immersed in the treatment liquid at the contact surface of the ultrasonic vibration system to facilitate the removal of unbound dye from the textile web for entrainment in the flow of treatment liquid.

21 Claims, 6 Drawing Sheets

U.S. PATENT DOCUMENTS

| | | | | |
|---|---|---|---|---|
| 4,425,718 | A | | 1/1984 | Kawaguchi |
| 4,482,239 | A | | 11/1984 | Hosono et al. |
| 4,483,571 | A | | 11/1984 | Mishiro |
| 4,494,956 | A | | 1/1985 | Schafer et al. |
| 4,511,520 | A | | 4/1985 | Bowen |
| 4,548,611 | A | | 10/1985 | Paterson et al. |
| 4,602,055 | A | | 7/1986 | Schafer et al. |
| 4,612,016 | A | | 9/1986 | Jaeger et al. |
| 4,626,642 | A | | 12/1986 | Wang et al. |
| 4,662,969 | A | | 5/1987 | Wang |
| 4,673,512 | A | | 6/1987 | Schram |
| 4,693,879 | A | | 9/1987 | Yoshimura et al. |
| 4,706,509 | A | | 11/1987 | Riebel |
| 4,707,402 | A | | 11/1987 | Thorsrud |
| 4,708,878 | A | | 11/1987 | Hagelauer et al. |
| 4,743,361 | A | | 5/1988 | Schram |
| 4,751,529 | A | | 6/1988 | Elrod et al. |
| 4,861,342 | A | | 8/1989 | Danel |
| 4,877,516 | A | | 10/1989 | Schram |
| 4,879,011 | A | | 11/1989 | Schram |
| 4,879,564 | A | | 11/1989 | Long |
| 4,906,497 | A | | 3/1990 | Hellmann et al. |
| 4,929,279 | A | | 5/1990 | Hays |
| 4,945,121 | A | | 7/1990 | Micale et al. |
| 4,969,968 | A | | 11/1990 | Leatherman |
| RE33,524 | E | | 1/1991 | Schram |
| 4,991,539 | A | | 2/1991 | Sarda |
| 4,992,636 | A | | 2/1991 | Namiki |
| 5,002,587 | A | | 3/1991 | Berendt |
| 5,006,266 | A | | 4/1991 | Schram |
| 5,028,237 | A | | 7/1991 | Berendt |
| 5,059,249 | A | | 10/1991 | Hays |
| 5,169,571 | A | | 12/1992 | Buckley |
| 5,171,387 | A | | 12/1992 | Wuchinich |
| 5,189,078 | A | | 2/1993 | Johnson et al. |
| 5,193,362 | A | | 3/1993 | Otto |
| 5,193,913 | A | | 3/1993 | Rosenbaum |
| 5,217,768 | A | | 6/1993 | Walters et al. |
| 5,220,346 | A | | 6/1993 | Carreira et al. |
| 5,238,975 | A | | 8/1993 | Johnson et al. |
| 5,242,557 | A | | 9/1993 | Jones et al. |
| 5,244,525 | A | | 9/1993 | Neuwirth et al. |
| 5,246,467 | A | * | 9/1993 | Cockett et al. ..... 8/543 |
| 5,272,216 | A | | 12/1993 | Clark, Jr. et al. |
| 5,338,611 | A | | 8/1994 | Lause et al. |
| 5,340,649 | A | | 8/1994 | Roeker et al. |
| 5,346,932 | A | | 9/1994 | Takahashi et al. |
| 5,368,199 | A | | 11/1994 | Haas et al. |
| 5,400,460 | A | | 3/1995 | Roeker et al. |
| 5,423,260 | A | | 6/1995 | Goldberg et al. |
| 5,442,160 | A | | 8/1995 | Kimrey, Jr. et al. |
| 5,446,270 | A | | 8/1995 | Chamberlain et al. |
| 5,466,722 | A | | 11/1995 | Stoffer et al. |
| 5,487,853 | A | | 1/1996 | Buckley |
| 5,500,668 | A | | 3/1996 | Malhotra et al. |
| 5,536,921 | A | | 7/1996 | Hedrick et al. |
| 5,543,605 | A | | 8/1996 | Kimrey, Jr. et al. |
| 5,563,644 | A | | 10/1996 | Isganitis et al. |
| 5,603,795 | A | | 2/1997 | Paulauskas et al. |
| 5,631,685 | A | | 5/1997 | Gooray et al. |
| 5,652,019 | A | | 7/1997 | Moran |
| 5,709,737 | A | | 1/1998 | Malhotra et al. |
| 5,770,296 | A | | 6/1998 | Remerowski et al. |
| 5,798,395 | A | | 8/1998 | Lauf et al. |
| 5,803,270 | A | | 9/1998 | Brodeur |
| 5,804,801 | A | | 9/1998 | Lauf et al. |
| 5,814,138 | A | | 9/1998 | Fague |
| 5,831,166 | A | | 11/1998 | Kozuka et al. |
| 5,851,274 | A | | 12/1998 | Lin |
| 5,853,469 | A | | 12/1998 | Colt et al. |
| 5,871,872 | A | | 2/1999 | Matijevic et al. |
| 5,902,489 | A | | 5/1999 | Yasuda et al. |
| 5,913,904 | A | | 6/1999 | Meyer et al. |
| 5,916,203 | A | | 6/1999 | Brandon et al. |
| 5,979,664 | A | | 11/1999 | Brodeur |
| 5,984,468 | A | | 11/1999 | Malhotra |
| 5,989,475 | A | | 11/1999 | Schulthess et al. |
| 6,007,662 | A | | 12/1999 | Remerowski et al. |
| 6,024,822 | A | | 2/2000 | Alper et al. |
| 6,045,648 | A | | 4/2000 | Palmgren et al. |
| 6,055,859 | A | | 5/2000 | Kozuka et al. |
| 6,074,466 | A | | 6/2000 | Iwasa |
| 6,089,702 | A | | 7/2000 | Hilton |
| 6,103,812 | A | | 8/2000 | Wei et al. |
| 6,114,676 | A | | 9/2000 | Jerby et al. |
| 6,117,192 | A | * | 9/2000 | Tate ..... 8/611 |
| 6,129,767 | A | | 10/2000 | Hong |
| 6,203,151 | B1 | | 3/2001 | Ruhe |
| 6,221,258 | B1 | | 4/2001 | Feke et al. |
| 6,254,787 | B1 | | 7/2001 | Kimura et al. |
| 6,303,061 | B1 | | 10/2001 | Hewins |
| 6,332,541 | B1 | | 12/2001 | Coakley et al. |
| 6,348,679 | B1 | | 2/2002 | Ryan et al. |
| 6,350,792 | B1 | | 2/2002 | Smetana et al. |
| 6,368,994 | B1 | | 4/2002 | Sklyarevich |
| 6,381,995 | B1 | | 5/2002 | Hong |
| 6,409,329 | B1 | | 6/2002 | King |
| 6,419,798 | B1 | | 7/2002 | Topolkaraev et al. |
| 6,425,663 | B1 | | 7/2002 | Eastlund et al. |
| 6,431,702 | B2 | | 8/2002 | Ruhe |
| 6,436,513 | B1 | | 8/2002 | Kitamura et al. |
| 6,444,964 | B1 | | 9/2002 | Eastlund et al. |
| 6,457,823 | B1 | | 10/2002 | Cleary et al. |
| 6,467,350 | B1 | | 10/2002 | Kaduchak et al. |
| 6,508,550 | B1 | | 1/2003 | Eastlund et al. |
| 6,578,959 | B1 | | 6/2003 | Seccombe |
| 6,600,142 | B2 | | 7/2003 | Ryan et al. |
| 6,605,651 | B1 | | 8/2003 | Stangel |
| 6,646,026 | B2 | | 11/2003 | Fan et al. |
| 6,649,888 | B2 | | 11/2003 | Ryan et al. |
| 6,652,602 | B2 | | 11/2003 | Yang et al. |
| 6,663,239 | B2 | | 12/2003 | Wotton et al. |
| 6,673,178 | B2 | | 1/2004 | Ellner et al. |
| 6,683,287 | B2 | | 1/2004 | Behnke et al. |
| 6,686,573 | B2 | | 2/2004 | Behnke et al. |
| 6,719,422 | B2 | | 4/2004 | Wu et al. |
| 6,734,409 | B1 | | 5/2004 | Wang et al. |
| 6,783,623 | B2 | | 8/2004 | Morin et al. |
| 6,822,135 | B2 | | 11/2004 | Soerens et al. |
| 6,846,448 | B2 | | 1/2005 | Rymer et al. |
| 6,855,760 | B1 | | 2/2005 | Kirsten et al. |
| 6,866,378 | B2 | | 3/2005 | Wotton et al. |
| 6,901,683 | B2 | | 6/2005 | Lyle et al. |
| 6,902,650 | B2 | | 6/2005 | Park et al. |
| 6,929,750 | B2 | | 8/2005 | Laurell et al. |
| 7,034,266 | B1 | | 4/2006 | DeGroot et al. |
| 7,186,772 | B2 | | 3/2007 | Berkau et al. |
| 2002/0074380 | A1 | | 6/2002 | Ellner et al. |
| 2002/0079121 | A1 | | 6/2002 | Ryan et al. |
| 2002/0133888 | A1 | | 9/2002 | Boyes |
| 2002/0142106 | A1 | | 10/2002 | Bethune et al. |
| 2003/0116888 | A1 | | 6/2003 | Rymer et al. |
| 2003/0118814 | A1 | | 6/2003 | Workman, Jr. et al. |
| 2003/0118825 | A1 | | 6/2003 | Melius et al. |
| 2003/0119406 | A1 | | 6/2003 | Abuto |
| 2004/0065599 | A1 | | 4/2004 | Lal et al. |
| 2004/0130606 | A1 | | 7/2004 | Tawaraya et al. |
| 2004/0179076 | A1 | | 9/2004 | Cohen et al. |
| 2004/0222080 | A1 | | 11/2004 | Tour et al. |
| 2004/0232583 | A1 | | 11/2004 | Monsheimer et al. |
| 2005/0008560 | A1 | | 1/2005 | Kataoka et al. |
| 2005/0082234 | A1 | | 4/2005 | Solenthaler |
| 2005/0100812 | A1 | | 5/2005 | Schultheis et al. |
| 2005/0132906 | A1 | | 6/2005 | Fernfors et al. |

| | | | |
|---|---|---|---|
| 2005/0202578 | A1 | 9/2005 | Yaniv et al. |
| 2005/0235740 | A1 | 10/2005 | Desie et al. |
| 2005/0238804 | A1 | 10/2005 | Garbar et al. |
| 2008/0062811 | A1 | 3/2008 | Janssen et al. |
| 2008/0063718 | A1 | 3/2008 | Janssen et al. |
| 2008/0063806 | A1 | 3/2008 | Janssen et al. |
| 2008/0156428 | A1 | 7/2008 | Janssen et al. |

FOREIGN PATENT DOCUMENTS

| | | | |
|---|---|---|---|
| EP | 0063203 | A1 | 10/1982 |
| EP | 0065057 | A1 | 11/1982 |
| EP | 0065058 | A1 | 11/1982 |
| EP | 0003684 | B1 | 5/1983 |
| EP | 0031862 | B1 | 2/1984 |
| EP | 0141556 | A2 | 5/1985 |
| EP | 0170758 | A1 | 2/1986 |
| EP | 0188105 | A1 | 7/1986 |
| EP | 0212655 | | 3/1987 |
| EP | 0281041 | B1 | 9/1988 |
| EP | 0303803 | B1 | 2/1989 |
| EP | 0455265 | | 11/1991 |
| EP | 0459967 | | 12/1991 |
| EP | 0549542 | A1 | 6/1993 |
| EP | 0625606 | B1 | 11/1994 |
| EP | 0282015 | B1 | 6/1995 |
| EP | 0667245 | A1 | 8/1995 |
| EP | 0798116 | A1 | 10/1997 |
| EP | 0907423 | | 4/1999 |
| EP | 0969131 | B1 | 1/2000 |
| EP | 0984045 | | 3/2000 |
| EP | 1010796 | | 6/2000 |
| EP | 1010796 | B1 | 6/2000 |
| EP | 1029651 | | 8/2000 |
| EP | 1238034 | B1 | 12/2003 |
| EP | 1371697 | A2 | 12/2003 |
| EP | 1396316 | | 3/2004 |
| EP | 0984045 | B1 | 9/2004 |
| EP | 1541322 | A2 | 6/2005 |
| FR | 2175286 | | 10/1973 |
| FR | 2878536 | | 6/2006 |
| GB | 631882 | | 11/1949 |
| GB | 850365 | | 10/1960 |
| GB | 1124787 | | 8/1968 |
| GB | 1229200 | A | 4/1971 |
| GB | 1257807 | A | 12/1971 |
| GB | 1363277 | A | 8/1974 |
| GB | 1404575 | | 9/1975 |
| GB | 1466735 | | 3/1977 |
| GB | 1482755 | A | 8/1977 |
| GB | 1583953 | A | 2/1981 |
| GB | 2120497 | | 11/1983 |
| GB | 2350321 | A | 11/2000 |
| JP | 54068842 | A | 6/1979 |
| JP | 55107490 | A | 8/1980 |
| JP | 56028221 | | 3/1981 |
| JP | 57119853 | | 7/1982 |
| JP | 58034051 | | 2/1983 |
| JP | 59171682 | A | 9/1984 |
| JP | 60101090 | A | 6/1985 |
| JP | 61291190 | A | 12/1986 |
| JP | 63072364 | | 4/1988 |
| JP | 63104664 | | 5/1988 |
| JP | 63318438 | A | 12/1988 |
| JP | 1108081 | | 4/1989 |
| JP | 1163074 | A | 6/1989 |
| JP | 1213486 | A | 8/1989 |
| JP | 2025602 | | 1/1990 |
| JP | 2167700 | A | 6/1990 |
| JP | 2220812 | A | 9/1990 |
| JP | 2262178 | A | 10/1990 |
| JP | 3036034 | A | 2/1991 |
| JP | 3086258 | | 4/1991 |
| JP | 3099883 | A | 4/1991 |
| JP | 3137283 | A | 6/1991 |
| JP | 3244594 | A | 10/1991 |
| JP | 04257445 | | 9/1992 |
| JP | 4257445 | A | 9/1992 |
| JP | 6228824 | | 8/1994 |
| JP | 7198257 | A | 8/1995 |
| JP | 7314661 | A | 12/1995 |
| JP | 8304388 | | 11/1996 |
| JP | 9286943 | | 11/1997 |
| JP | 10060331 | | 3/1998 |
| JP | 10112384 | A | 4/1998 |
| JP | 10112385 | A | 4/1998 |
| JP | 10112386 | A | 4/1998 |
| JP | 10112387 | A | 4/1998 |
| JP | 10315336 | A | 12/1998 |
| JP | 11034590 | A | 2/1999 |
| JP | 11133661 | | 5/1999 |
| JP | 2000144582 | A | 5/2000 |
| JP | 2000158364 | | 6/2000 |
| JP | 2001228733 | A | 8/2001 |
| JP | 2001252588 | | 9/2001 |
| JP | 2002210920 | A | 7/2002 |
| JP | 2004020176 | | 1/2004 |
| JP | 2004082530 | | 3/2004 |
| JP | 2004238012 | A | 8/2004 |
| JP | 2004256783 | | 9/2004 |
| JP | 2005118688 | | 5/2005 |
| JP | 01213458 | | 8/2007 |
| WO | 8910258 | | 11/1989 |
| WO | 9117889 | | 11/1991 |
| WO | 9420833 | | 9/1994 |
| WO | 9620784 | A1 | 7/1996 |
| WO | 9628599 | | 9/1996 |
| WO | 9743026 | | 11/1997 |
| WO | 9817373 | | 4/1998 |
| WO | 9822250 | | 5/1998 |
| WO | 9844058 | | 10/1998 |
| WO | 9961539 | | 12/1999 |
| WO | 0004978 | | 2/2000 |
| WO | 0026011 | A1 | 5/2000 |
| WO | 0026026 | | 5/2000 |
| WO | 0029178 | | 5/2000 |
| WO | 0031189 | | 6/2000 |
| WO | 0041794 | | 7/2000 |
| WO | 0109262 | A1 | 2/2001 |
| WO | 0110635 | | 2/2001 |
| WO | 0121725 | | 3/2001 |
| WO | 0136116 | | 5/2001 |
| WO | 0136117 | | 5/2001 |
| WO | 0250511 | | 6/2002 |
| WO | 02062894 | | 8/2002 |
| WO | 02064354 | | 8/2002 |
| WO | 03016030 | | 2/2003 |
| WO | 03102737 | | 12/2003 |
| WO | 03106143 | | 12/2003 |
| WO | 03106573 | | 12/2003 |
| WO | 03106600 | | 12/2003 |
| WO | 2004011044 | | 2/2004 |
| WO | 2004037902 | | 5/2004 |
| WO | 2004048463 | | 6/2004 |
| WO | 2004050350 | | 6/2004 |
| WO | 2004063295 | | 7/2004 |
| WO | 2004076578 | | 9/2004 |
| WO | 2004091841 | | 10/2004 |
| WO | 2004092048 | | 10/2004 |
| WO | 2005028577 | | 3/2005 |
| WO | 2005073329 | | 8/2005 |
| WO | 2005080066 | | 9/2005 |
| WO | 2006004765 | | 1/2006 |
| WO | 2006055038 | | 5/2006 |

WO 2006074921 7/2006

OTHER PUBLICATIONS

U.S. Appl. No. 11/617,417, filed Dec. 28, 2006.
U.S. Appl. No. 11/777,116, filed Jul. 12, 2007.
U.S. Appl. No. 11/617,405, filed Dec. 28, 2006.
U.S. Appl. No. 11/777,124, filed Jul. 12, 2007.
U.S. Appl. No. 11/646,816, filed Dec. 28, 2006.
U.S. Appl. No. 11/647,534, filed Dec. 28, 2006.
U.S. Appl. No. 11/617,473, filed Dec. 28, 2006.
U.S. Appl. No. 11/777,128, filed Jul. 12, 2007.
U.S. Appl. No. 11/965,435, filed Dec. 27, 2006.
International Search Report and Written Opinion regarding PCT/IB2007/054897, dated Apr. 16, 2008.
International Search Report and Written Opinion regarding PCT/IB2007/054889, dated Apr. 16, 2008.
International Search Report and Written Opinion regarding PCT/IB2007/054905 dated May 6, 2008.
International Search Report and Written Opinion regarding PCT/IB2007/054909 dated May 8, 2008.
Biria, M., et al. "Continuous Dyeing of Cotton Using Ultrasound" AATCC Book of Papers, IC&E, 1996, pp. 309-322.
Mathur, M. R., et al. "Energy Conservation in Wet Processing: Development of Low Energy Dyeing Machine." Colourage Annual. 2004. pp. 93-99.
"Ultrasonics Sound Technology for Textiles and Nonwovens" Express Textile, Issue Dated Aug. 21, 2003, 5 pages.
Vajnhandl, S., et al. "Ultrasound in Textile Dyeing and the Decolouration/Mineralization of Textile Dyes" Dyes and Pigments. (2005), 65, pp. 89-101.
Office Action regarding U.S. Appl. No. 11/646,816, dated May 30, 2008.
Office Action regarding U.S. Appl. No. 11/647,534, dated May 30, 2008.
Final office action regarding U.S. Appl. No. 11/647,534, dated Dec. 4, 2008.
Non-final office action regarding U.S. Appl. No. 11/646,816, dated Dec. 15, 2008.
Non-final Office Action, U.S. Appl. No. 11/617,405 (Feb. 3, 2009).
Non-final Office Action regarding U.S. Appl. No. 11/647,534, dated Feb. 11, 2009.
Non-final Office Action, U.S. Appl. No. 11/617,417 (Mar. 9, 2009).
Non-final Office Action regarding U.S. Appl. No. 11/777,124, dated Apr. 20, 2009.
Non-final Office Action regarding U.S. Appl. No. 11/617,473, dated Jun. 2, 2009.

* cited by examiner

PROCESS FOR DYEING A TEXTILE WEB

FIELD OF INVENTION

This invention relates generally to processes for dyeing textile webs, and more particularly to a process for dyeing a textile web in which unbound dye is removed from the web following initial dyeing of the web.

BACKGROUND

Textile dyeing processes typically involve applying a dye to the textile web, such as by ink jet systems, spray systems, gravure roll, slot die, rod coater, rotary screen curtain coater, air knife, brush or other suitable application system or technique, followed by heating and/or steaming of the dyed textile web to promote binding of the dye to the textile web. Following the steaming operation, the textile web may be washed, such as in a bath of water or other cleaning solution, to remove unbound and excess dye from the web. For example, in some washing processes the textile web is immersed in a cleaning bath where the cleaning solution (typically water) flows over the web to wash away unbound dye.

The washing sequence of such a conventional textile dyeing process is often a relatively slow process because it relies on the diffusion of unbound dye molecules in the matrix of the textile web to reach the surface of the textile where it can become entrained in the flow of cleaning solution. Additionally, washing the dyed textile in this manner may require multiple washings to remove a desired amount of unbound dye from the web.

The application of ultrasonic energy to a textile web in the course of textile processing is also known. For example, as described in U.S. Pat. No. 4,302,485 (Last et al.), ultrasonic treatment may be applied to a textile web while the web is immersed in a bath of dye solution or other treatment solution wherein the ultrasonic energy increases the penetration of the dye or other treatment solution into the web. However, such a process requires a substantial amount (e.g, the entire bath) of dye to be used compared to the amount of dye that is ultimately desired in the web.

There is a need, therefore, for a dyeing process that reduces the amount of dye that needs to be used in dyeing a textile web and/or more readily removes unbound dye from a web during processing without removing already bound dye.

SUMMARY

In accordance with embodiment, a process for dyeing a textile web having a first face and a second face opposite the first face generally comprises applying dye to the textile web and immersing the dyed textile web in a flowing treatment liquid with the textile web in a generally open configuration. A contact surface of an ultrasonic vibration system is immersed in the flowing treatment liquid with the contact surface in direct contact with at least a portion of the textile web immersed in the treatment liquid. The ultrasonic vibration system is operated to impart ultrasonic energy to the portion of the textile web immersed in the treatment liquid at the contact surface of the ultrasonic vibration system to facilitate the removal of unbound dye from the textile web for entrainment in the flow of treatment liquid.

In another embodiment, a process for dyeing a textile web having a first face and a second face opposite the first face generally comprises applying dye to the textile web and directing the textile web into a holding tank containing a treatment liquid with the textile web being immersed in the treatment liquid. The treatment liquid flows within the holding tank from an inlet of the tank at which the treatment liquid enters the tank to an outlet of the tank at which the treatment liquid exits the tank. A contact surface of an ultrasonic vibration system is immersed in the treatment liquid within the tank with the contact surface in direct contact with at least a portion of the textile web immersed in the treatment liquid. The ultrasonic vibration system is operated to impart ultrasonic energy to the portion of the textile web immersed in the treatment liquid at the contact surface of the ultrasonic vibration system to facilitate the removal of unbound dye from the textile web for entrainment in the flow of treatment liquid. Dye is filtered from the treatment liquid after the treatment liquid exits the holding tank.

BRIEF DESCRIPTION OF THE DRAWINGS

Corresponding reference characters indicate corresponding parts throughout the drawings.

DETAILED DESCRIPTION

Figure 1:
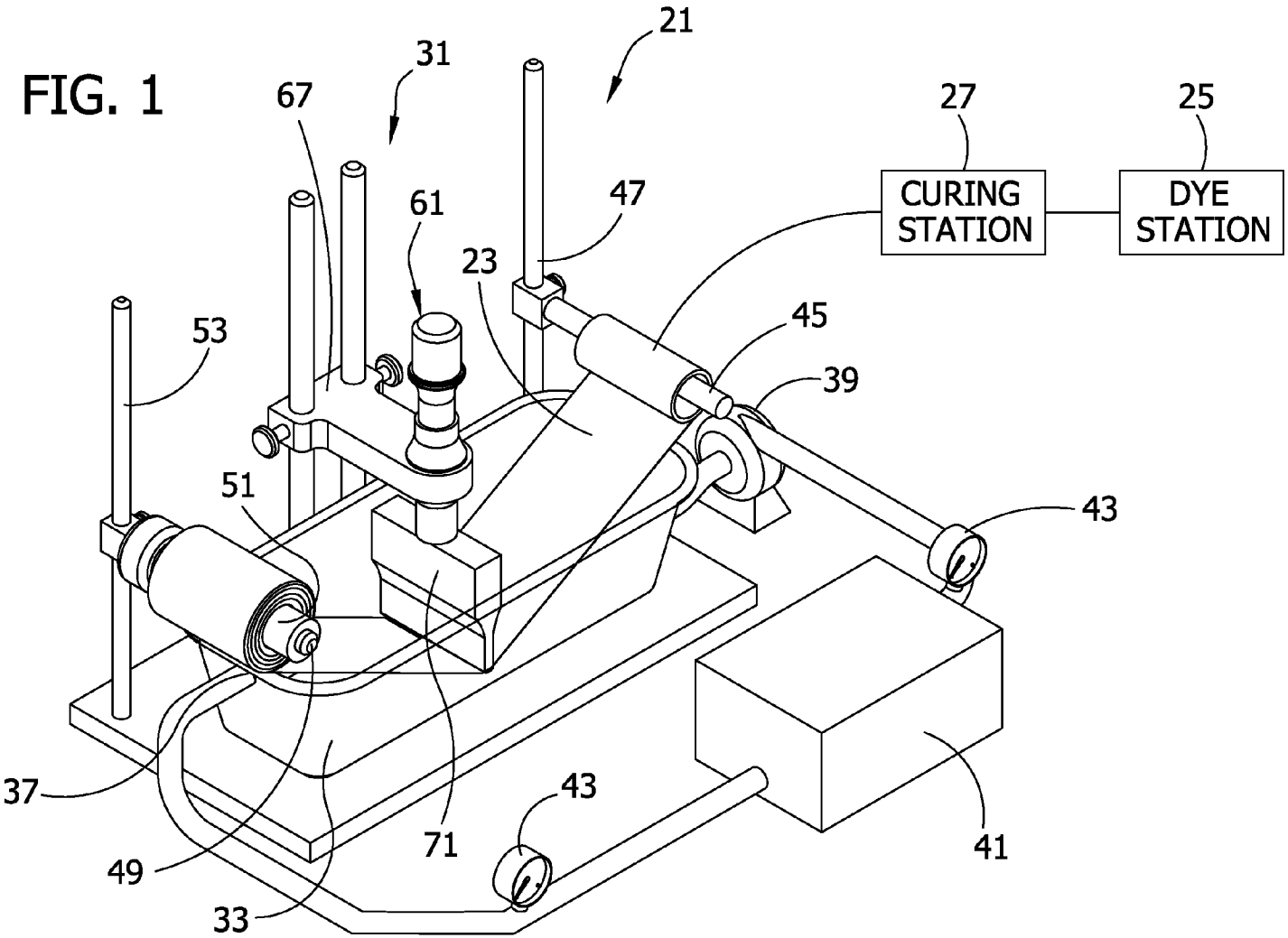
FIG. 1 is a schematic perspective of one embodiment of apparatus for dyeing a textile web according to one embodiment of a process for dyeing a textile web, with a dye station indicated schematically and with an ultrasonic vibration system of rinsing station of the apparatus illustrated in an immersed position of the vibration system.

With reference now to the drawings and in particular to FIG. 1, one embodiment of apparatus for use in dyeing a textile web 23 is generally designated 21. The textile web 23 to be processed by the apparatus 21 may suitably be a woven web or a non-woven web, including without limitation bonded-carded webs, spunbond webs and meltblown webs, polyesters, polyolefins, cotton, nylon, silks, hydroknit, coform, nanofiber, fluff batting, foam, elastomerics, rubber, film laminates, combinations of these materials or other suitable materials. The textile web 23 may be a single web layer or a multilayer laminate in which one or more layers of the laminate are suitable for being dyed.

The term "spunbond" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (from a sample of at least 10) larger than 7 microns, more particularly, between about 10 and 20 microns.

The term "meltblown" refers to fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin et al. Meltblown fibers are microfibers which may be continuous or discontinuous, are generally smaller than 10 microns in average diameter, and are generally tacky when deposited onto a collecting surface.

Laminates of spunbond and meltblown fibers may be made, for example, by sequentially depositing onto a moving forming belt first a spunbond web layer, then a meltblown web layer and last another spunbond web layer and then bonding the layers together. Alternatively, the web layers may be made individually, collected in rolls, and combined in a separate bonding step. Such laminates usually have a basis weight of from about 0.1 to 12 osy (6 to 400 gsm), or more particularly from about 0.75 to about 3 osy.

The dyeing apparatus 21 illustrated in FIG. 1 comprises a dye station, schematically and generally indicated at 25, at which dye is applied to the textile. The term "dye" as used herein refers to a substance that imparts more or less permanent color to other materials, such as to the textile web 23. Suitable dyes include, without limitation, inks, lakes (also often referred to as color lakes), dyestuffs (for example but not limited to acid dyes, azoic dyes, basic dyes, direct dyes, disperse dyes, food, drug and cosmetic dyes, ingrain dyes, leather dyes, mordant dyes, natural dyes, reactive dyes, solvent dyes sulfur dyes and vat dyes), pigments (organic and inorganic) and other colorants (for example but not limited to fluorescent brighteners, developers, oxidation bases). The dye station 25 may comprise any suitable device used for applying dye to textile webs 23, whether the dye is pre-metered (e.g., in which little or no excess dye is applied upon initial application of the dye) or post-metered (i.e., an excess amount of dye is applied to the textile web and subsequently removed). It is understood that the dye itself may be applied to the textile web 23 or the dye may used in a dye solution that is applied to the web.

Examples of suitable pre-metered dye applicating devices include, without limitation, devices for carrying out the following known applicating techniques:

Slot die: The dye is metered through a slot in a printing head directly onto the textile web 23.

Direct gravure: The dye is in small cells in a gravure roll. The textile web 23 comes into direct contact with the gravure roll and the dye in the cells is transferred onto the textile web.

Offset gravure with reverse roll transfer: Similar to the direct gravure technique except the gravure roll transfers the coating material to a second roll. This second roll then comes into contact with the textile web 23 to transfer dye onto the textile web.

Curtain coating: This is a coating head with multiple slots in it. Dye is metered through these slots and drops a given distance down onto the textile web 23.

Slide (Cascade) coating: A technique similar to curtain coating except the multiple layers of dye come into direct contact with the textile web 23upon exiting the coating head. There is no open gap between the coating head and the textile web 23.

Forward and reverse roll coating (also known as transfer roll coating): This consists of a stack of rolls which transfers the dye from one roll to the next for metering purposes. The final roll comes into contact with the textile web 23. The moving direction of the textile web 23 and the rotation of the final roll determine whether the process is a forward process or a reverse process.

Extrusion coating: This technique is similar to the slot die technique except that the dye is a solid at room temperature. The dye is heated to melting temperature in the print head and metered as a liquid through the slot directly onto the textile web 23. Upon cooling, the dye becomes a solid again.

Rotary screen: The dye is pumped into a roll which has a screen surface. A blade inside the roll forces the dye out through the screen for transfer onto the textile.

Spray nozzle application: The dye is forced through a spray nozzle directly onto the textile web 23. The desired amount (pre-metered) of dye can be applied, or the textile web 23 may be saturated by the spraying nozzle and then the excess dye can be squeezed out (post-metered) by passing the textile web through a nip roller.

Flexographic printing: The dye is transferred onto a raised patterned surface of a roll. This patterned roll then contacts the textile web 23 to transfer the dye onto the textile.

Digital textile printing: The dye is loaded in an ink jet cartridge and jetted onto the textile web 23 as the textile web passes under the ink jet head.

Examples of suitable post-metering dye applicating devices for applying the dye to the textile web 23 include without limitation devices that operate according to the following known applicating techniques:

Rod coating: The dye is applied to the surface of the textile web 23 and excess dye is removed by a rod. A Mayer rod is the prevalent device for metering off the excess dye.

Air knife coating: The dye is applied to the surface of the textile web 23 and excess dye is removed by blowing it off using a stream of high pressure air.

Knife coating: The dye is applied to the surface of the textile web 23 and excess dye is removed by a head in the form of a knife.

Blade coating: The dye is applied to the surface of the textile web 23 and excess dye is removed by a head in the form of a flat blade.

Dip coating (saturating) followed by squeeze roll: The textile web 23 is immersed in the dye and then pulled through a nip between two rollers to squeeze out excess material.

Spin coating: The textile web 23 is rotated at high speed and excess dye applied to the rotating textile web spins off the surface of the web.

Fountain coating: The dye is applied to the textile web 23 by a flooded fountain head and excess material is removed by a blade.

Brush application: The dye is applied to the textile web 23 by a brush and excess material is regulated by the movement of the brush across the surface of the web.

Following the application of dye to the textile web 23, the dyed textile web may be delivered to a curing station, schematically and generally indicated at 27, at which the dyed textile web is subjected to a heat treatment, a steam treatment and/or other known curing treatment to promote binding of the dye to the textile web. It is contemplated, however, that the curing station 27 may be omitted from the dyeing apparatus 21 without departing from the scope of this invention.

In the illustrated embodiment, the dyed and cured textile web 23 is suitably in the form of a generally continuous web, and more particularly a rolled web wherein the web is unrolled during treatment and then rolled up again for transport. For example, after the textile web 23 is dyed and cured, it is rolled up for transport to a washing station, indicated generally at 31. It is understood, however, that the textile web 23 may alternatively be in the form of one or more discrete webs during treatment and transport without departing from the scope of this invention. It is also contemplated that the web 23 may be fed from one station (e.g., the curing station 27) to the next (e.g., to the washing station) without intervening transport and that the web may remain unrolled or otherwise open as it is fed from one station to the next.

At the washing station 31, the dyed and cured (and, in the illustrated embodiment, rolled up) textile web 23 transported in a machine direction through the washing station whereby a washing process is conducted to wash unbound dye from the web. The term "machine direction" as used herein refers generally to the direction in which the textile web 23 is moved (e.g., longitudinally of the web in the illustrated embodiment) along the washing station. The term "cross-machine direction" is used herein to refer to the direction normal to the machine direction of the textile web 23 and generally in the plane of the web (e.g., widthwise of the web in the illustrated embodiment).

The washing station 31, according to one suitable embodiment, comprises a holding tank 33 open at its top and containing a suitable treatment liquid 35 in which the textile web 23 is immersed during the washing process to wash away unbound dye from the textile web. Such a treatment liquid 35 may, for example, comprise water, a solution of water and a washing agent other than water, or other suitable liquid solutions that facilitate the washing away of unbound dye from the textile. However, in a particularly suitable embodiment the treatment liquid 35 suitably contains no dye or other materials that are intended to be taken into the textile web 23 at the washing station 31.

It is understood, however, that other treatment agents may be disposed in the treatment liquid. Examples of such agents include, without limitation, alcohols, ketones, petroleum ether, hydrocarbons, aromatics, surfactants, freons (halohydrocarbons), silicones, silicone polyethers, curing agents, fluorocarbons, fluorescent agents, stabilizers, titanium dioxide, UV absorbers, fragrances, insect repellents, activated carbon, silica or carbonates, and nanoparticle systems.

It is also understood that the top of the holding tank 33 need not be entirely open, or it may be closed altogether, to remain within the scope of this invention. For example, the web 23 may instead enter the holding tank 33 through one end wall of the tank and exit the tank through the opposite end wall thereof.

In the illustrated embodiment of FIG. 2, the treatment liquid 35 is suitably caused to flow, swirl or otherwise agitate within the holding tank 33, and in a more suitable embodiment it flows continuously into, through, and then subsequently outward from the tank. For example, the holding tank of FIGS. 1 and 2 has an inlet 37 through which treatment liquid 35 enters the tank, an outlet (not shown) through which contaminated treatment liquid (e.g., with dye removed from the textile web 23 entrained in the liquid) exits the tank, and suitable apparatus 39 operable to circulate or otherwise cause the treatment liquid to flow within the tank from the inlet to the outlet.

In a particularly suitable embodiment, the treatment liquid 35 is directed to flow within the tank 31 in a direction that is generally opposite to the direction (e.g., the machine direction) in which the textile web 23 is moved through the tank for washing, at least at the segment of the web that is being treated at any given time as will be described later herein. For example, in the embodiment illustrated in FIG. 2, the textile web 23 is moved within the tank 33 in the machine direction indicated by the single arrow while the treatment liquid 35 flows within the tank in the direction indicated by the double arrow. It is understood, however, that the treatment liquid 35 may alternatively be directed to flow within the tank 33 generally in the same direction that the web 23 is moved through the tank and remain within the scope of this invention.

In other embodiments, it is contemplated that the treatment liquid 35 may instead remain within the tank 33 (e.g., instead of being continuously fed through the tank) and be circulated or otherwise agitated within the tank relative to the web 23 to facilitate the washing of unbound dye from the web. In such an embodiment, contaminated treatment liquid 35 may be intermittently drained or removed from the tank 33 and replaced with clean treatment liquid.

In one particularly suitable embodiment, the treatment liquid 35 exiting the tank 33 at the outlet thereof is suitably cleaned (i.e., the dye is removed) and re-circulated back to the inlet 37 for re-circulation through the tank to provide a generally closed-loop system at the washing station 31 so as to more efficiently use the treatment liquid. For example, in the illustrated embodiment of FIGS. 1 and 2, the circulation apparatus 39 comprises a suitable circulation pump disposed exterior of the tank 33 in flow communication with the tank outlet and is operable to draw treatment liquid 35 out of the tank and circulate the treatment liquid through the closed-loop system, including circulation back to the tank inlet 37 and within the tank in the desired direction, e.g., from the inlet to the outlet of the tank.

A suitable filter system 41 is disposed exterior of the tank 33 along the circulation path of the treatment liquid 35, such as intermediate the pump 39 and the tank inlet 37, for filtering or otherwise removing dye and/or other contaminating matter from the treatment liquid before the treatment liquid re-circulates back through the tank. In one suitable embodiment, for example, the filter system 41 may comprise the system described in co-pending U.S. application Ser. No. 11/530,183 filed Sep. 8, 2006 and entitled ULTRASONIC TREATMENT SYSTEM FOR SEPARATING COMPOUNDS FROM AQUEOUS EFFLUENT, the entire disclosure of which is incorporated herein by reference. It is understood, however, that any filter system suitable for filtering dye and other contaminates from the treatment liquid may be used without departing from the scope of this invention. One or more pressure gauges 43 are also provided along the circulation path of the treatment liquid 35 to monitor (and to permit the control of) the liquid pressure in the circulation path of the treatment liquid.

Figure 2:
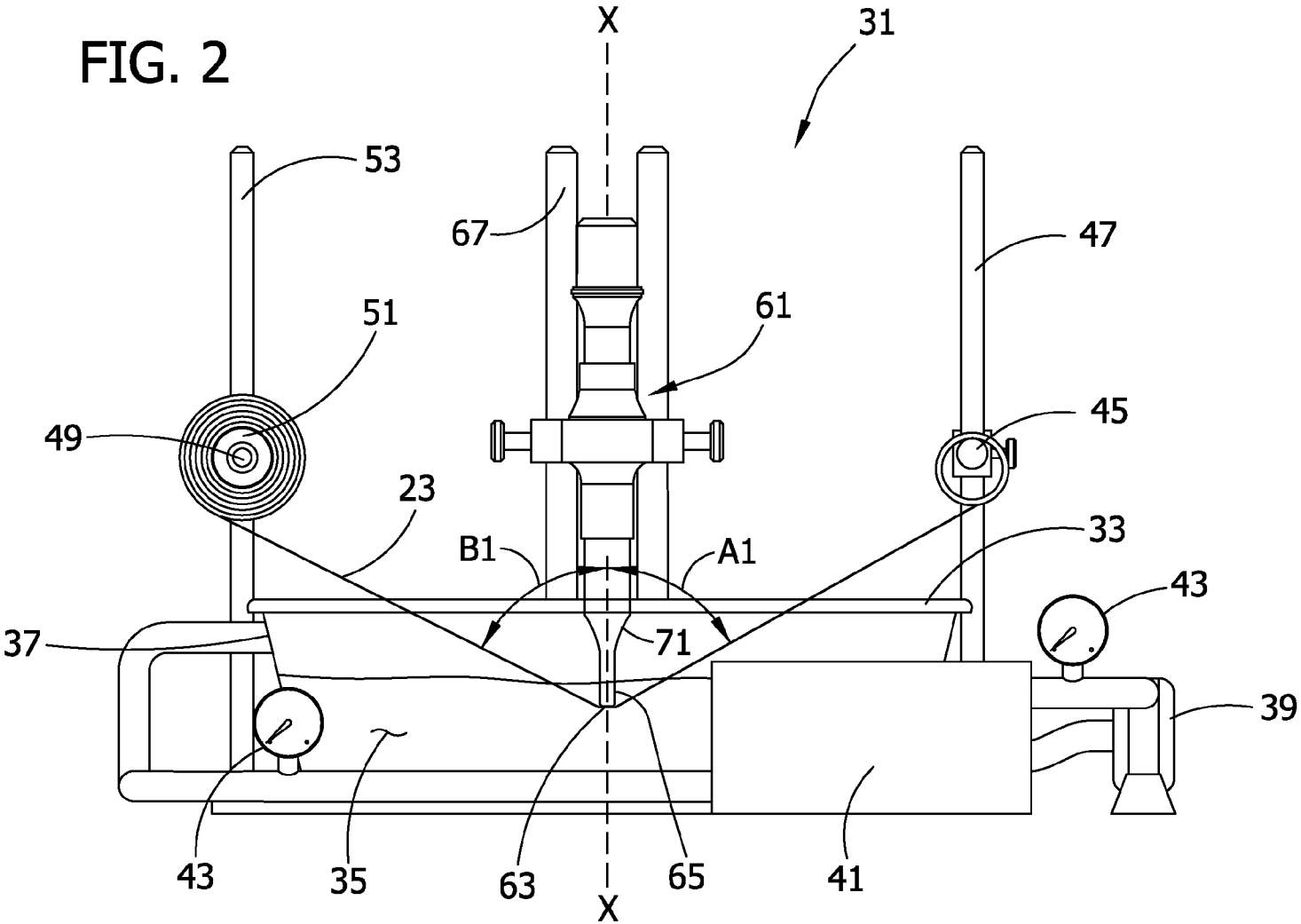
FIG. 2 is a side elevation of the rinsing station of the apparatus of FIG. 1.

Still referring to FIGS. 1 and 2, an unwind roll 45 is supported by suitable support structure 47 to hold a rolled up textile web 23 that has been dyed, and in some embodiments cured. A corresponding wind roll 49 and associated drive mechanism 51 are supported by additional support structure 53 in longitudinally spaced relationship with the unwind roll (e.g., toward opposite ends of the holding tank 31. The drive mechanism 51 is suitably operable to draw the textile web 23 from the unwind roll 45 along the machine direction of the web and onto the wind roll 49 where the textile web is rewound following ultrasonic treatment of the web to remove unbound dye from the web.

An ultrasonic vibration system, generally indicated at 61, is at least in part immersed within the treatment liquid 35 in the holding tank 33 and has a contact surface 63 (FIG. 2) over which the web 23 (i.e., the portion or segment of the web immersed in the washing solution) passes in contact with the vibration system such that the vibration system imparts ultrasonic energy to the web. In the illustrated embodiment, the ultrasonic vibration system 61 has a terminal end 65, at least a portion of which defines the contact surface 63 contacted by the textile web 23. With particular reference to FIG. 2, in the illustrated embodiment the textile web 23 advances from the unwind roll 45 toward the contact surface 63 (e.g., at the terminal end 65 of the ultrasonic vibration system 61) at an approach angle A1 relative to a longitudinal axis X of the ultrasonic vibration system 61, and after passing over the contact surface the web further advances away from the contact surface toward the wind roll 49 at a departure angle B1 relative to the longitudinal axis X of the ultrasonic vibration system.

The approach angle A1 of the textile web 23, in one embodiment, is suitably in the range of about 1 to about 89 degrees, more suitably in the range of about 1 to about 45 degrees, and even more suitably in the range of about 10 to about 45 degrees. The departure angle B1 of the web 23 is suitably approximately equal to the approach angle A1 as illustrated in FIG. 2. However, it is understood that the departure angle B1 may be greater than or less than the approach angle A1 without departing from the scope of this invention.

In the embodiment illustrated in FIG. 1, the ultrasonic vibration system 61 is suitably mounted on a support frame 67 intermediate the unwind roll 45 and the wind roll 49, and is more suitably adjustably mounted on the support frame for movement relative to the holding tank 33 (e.g., vertically in the embodiment illustrated in FIG. 1) and the unwind and wind rolls to permit adjustment of the contact surface 63 of the ultrasonic vibration system relative to the web 23 to be treated. For example, in FIG. 2A the vibration system 61 is vertically positioned in what is referred to herein as a withdrawn position in which the terminal end 65 (and hence the contact surface 63) of the ultrasonic vibration system is withdrawn from the treatment liquid 35 in the holding tank 33. The textile web is also disposed out of the treatment liquid 35 in the withdrawn position of the vibration system 61 and may but need not necessarily be in contact with the contact surface 63 of the vibration system.

FIGS. 1 and 2 illustrate the ultrasonic vibration system 61 in what is referred to herein as an immersed position in which the vibration system is positioned vertically lower than it is in the withdrawn position. In this immersed position, the terminal end 65 (and hence the contact surface 63) of the vibration system 61 is immersed in the treatment liquid 35 along with at least a longitudinal segment or portion of the textile web 23. Movement of the vibration system 61 from its withdrawn position to its immersed position in this embodiment urges the web 23 down into the treatment liquid 35 at the contact surface 63 of the vibration system and creates the approach and departure angles A1, B1 of the web.

Moving the ultrasonic vibration system 61 from its withdrawn position to its immersed position in this manner may also serve to tension, or increase the tension in, the textile web 23 at least along the segment of the web that lies against the contact surface 63 of the vibration system while the web is held between the unwind roll 45 and the wind roll 49. For example, in one embodiment the textile web 23 may be held in uniform tension along its width, at least at that segment of the web that is contacted by the contact surface 63 of the ultrasonic vibration system 61, in the range of about 0.05 pounds/inch of fabric width to about 3 pounds/inch of fabric width, and more suitably in the range of about 0.1 to about 0.5 pounds/inch of fabric width.

In one suitable embodiment, the contact surface 63 of the ultrasonic vibration system 63 is disposed just beneath the surface of the treatment liquid 35 in the holding tank 33 in the immersed position of the vibration system 61 to avoid having to unnecessarily immerse a larger portion of the vibration system therein. Immersing the textile web just beneath the surface of the treatment liquid also minimizes the amount of treatment liquid that must be used (which also allows for using a smaller (i.e., shallower) tank. As an example, the contact surface 63 of the ultrasonic vibration system 61 in one embodiment is disposed in the range of about 1 to about 5 inches below the surface of the treatment liquid 35 in the holding tank 33, and more suitably about one inch below the surface of the treatment liquid in the holding tank. It is understood, however, that the ultrasonic vibration system 61 may be further immersed in the treatment liquid 35 without departing from the scope of this invention.

Figure 3:
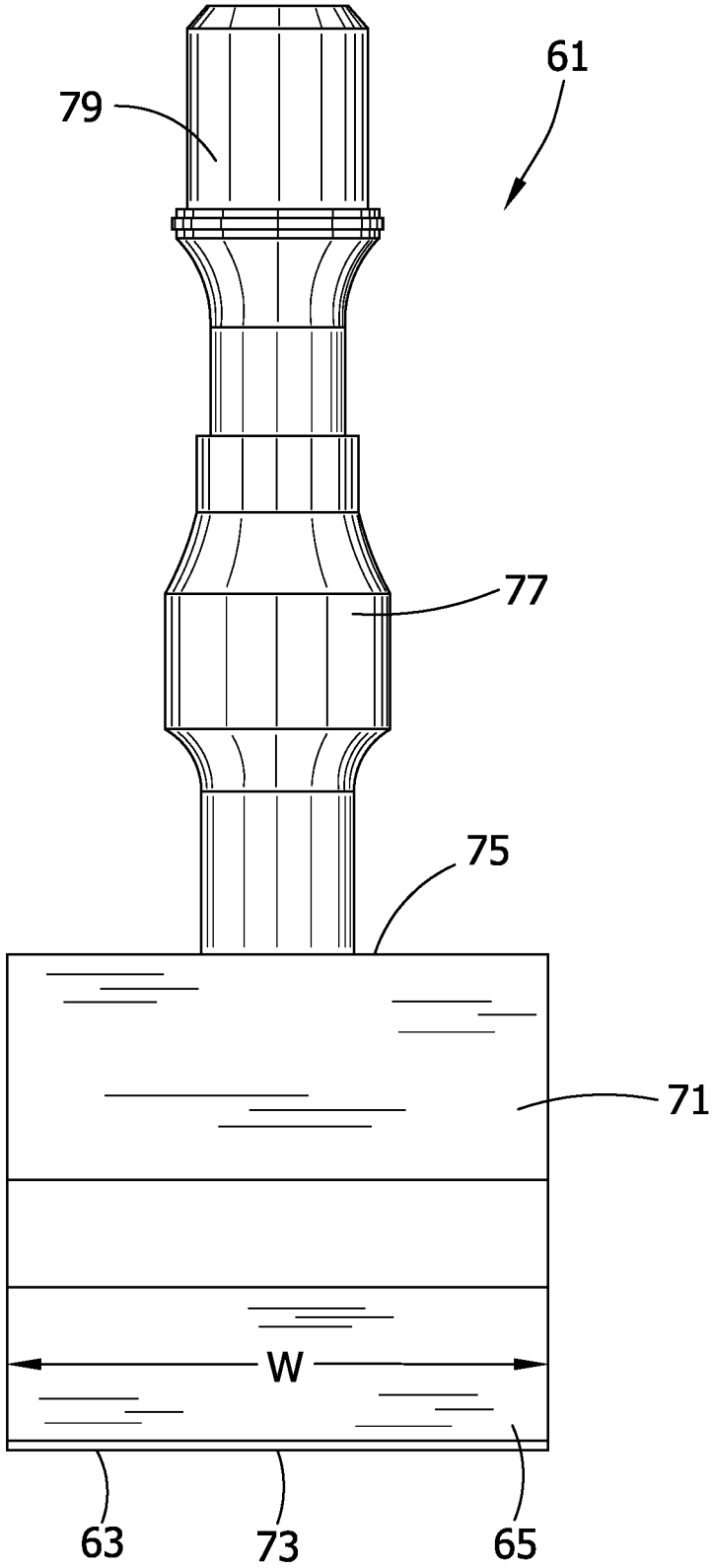
FIG. 3 is a front elevation of the ultrasonic vibration system of the apparatus of FIG. 1.

With particular reference now to FIG. 3, the ultrasonic vibration system 61 in one embodiment suitably comprises an ultrasonic horn, generally indicated at 71, having a terminal end 73 that in the illustrated embodiment defines the terminal end 65 of the vibration system, and more particularly defines the contact surface 63 of the vibration system. In particular, the ultrasonic horn 71 of FIG. 3 is suitably configured as what is referred to herein as an ultrasonic bar (also sometimes referred to as a blade horn) in which the terminal end 73 of the horn is generally elongate, e.g., along its width w. The ultrasonic horn 71 in one embodiment is suitably of unitary construction such that the contact surface 63 defined by the terminal end 73 of the horn is continuous across the entire width w of the horn.

Additionally, the terminal end 73 of the horn 71 is suitably configured so that the contact surface 63 defined by the terminal end of the ultrasonic horn is generally flat and rectangular. It is understood, however, that the horn 71 may be configured so that the contact surface 63 defined by the terminal end 73 of the horn is more rounded or other than flat without departing from the scope of this invention. The ultrasonic horn 71 is suitably oriented relative to the moving textile web 23 so that the terminal end 73 of the horn extends in the cross-machine direction across the width of the web. The width w of the horn 71, at least at its terminal end 73, is suitably sized approximately equal to and may even be greater than the width of the web.

Figure 4:
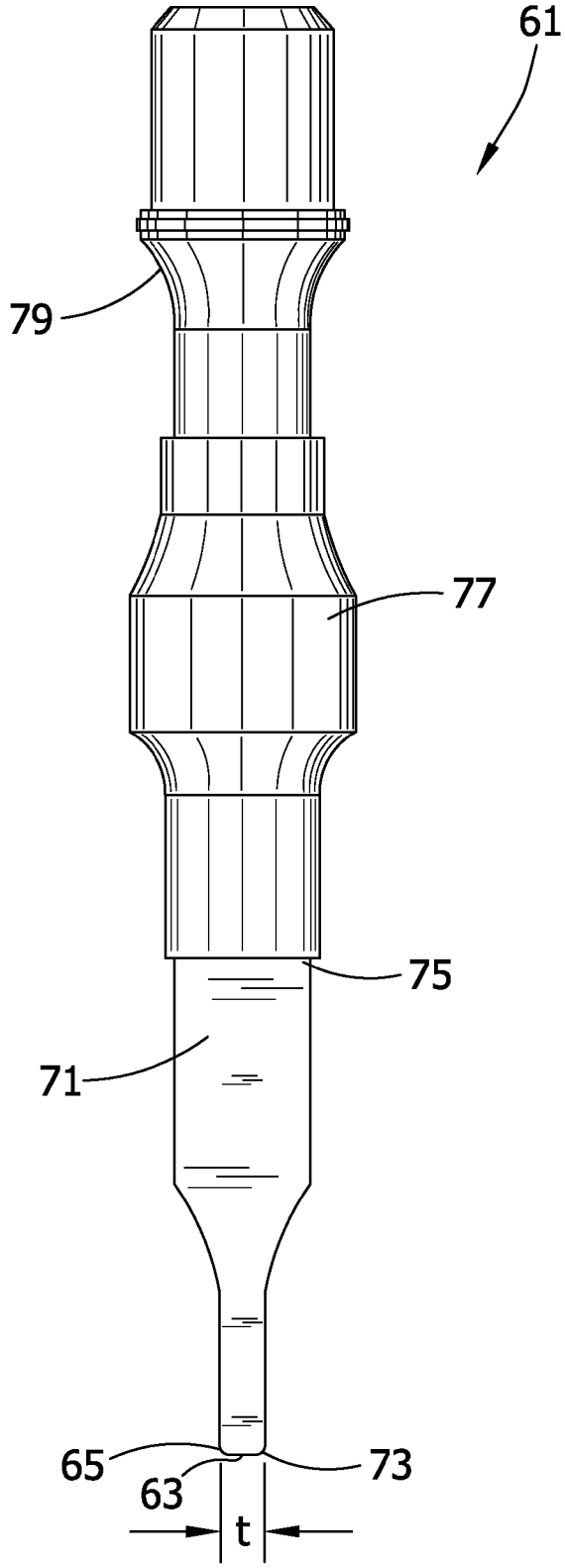
FIG. 4 is a side elevation thereof.

A thickness t (FIG. 4) of the ultrasonic horn 71 is suitably greater at a connection end 75 of the horn (i.e., the longitudinal end of the horn opposite the terminal end 73 thereof) than at the terminal end of the horn to facilitate increased vibratory displacement of the terminal end of the horn during ultrasonic vibration. As one example, the ultrasonic horn 71 of the illustrated embodiment of FIGS. 3 and 4 has a thickness t at its connection end 75 of approximately 1.5 inches (3.81 cm) while its thickness at the terminal end 73 is approximately 0.5 inches (1.27 cm). The illustrated horn 71 also has a width w of about 6.0 inches (15.24 cm) and a length (e.g., height in the illustrated embodiment) of about 5.5 inches (13.97 cm). The thickness t of the illustrated ultrasonic horn 71 tapers inward as the horn extends longitudinally toward the terminal end 73. It is understood, however, that the horn 71 may be configured other than as illustrated in FIGS. 3 and 4 and remain within the scope of this invention as long as the horn defines a contact surface 63 of the vibration system 61 suitable for contacting the textile web 23 to impart ultrasonic energy to the web.

The ultrasonic vibration system 61 of the illustrated embodiment is suitably in the form of what is commonly referred to as a stack, comprising the ultrasonic horn, a booster 77 coaxially aligned (e.g., longitudinally) with and connected at one end to the ultrasonic horn 71 at the connection end 75 of the horn, and a converter 79 (also sometimes referred to as a transducer) coaxially aligned with and connected to the opposite end of the booster. The converter 79 is in electrical communication with a power source or generator (not shown) to receive electrical energy from the power source and convert the electrical energy to high frequency mechanical vibration. For example, one suitable type of converter 79 relies on piezoelectric material to convert the electrical energy to mechanical vibration.

The booster 77 is configured to amplify (although it may instead be configured to reduce, if desired) the amplitude of the mechanical vibration imparted by the converter 79. The amplified vibration is then imparted to the ultrasonic horn 71. It is understood that the booster 77 may instead be omitted from the ultrasonic vibration system 61 without departing from the scope of this invention. Construction and operation of a suitable power source, converter 79 and booster 77 are known to those skilled in the art and need not be further described herein.

In one embodiment, the ultrasonic vibration system 61 is operable (e.g., by the power source) at a frequency in the range of about 15 kHz to about 100 kHz, more suitably in the range of about 15 kHz to about 60 kHz, and even more suitably in the range of about 20 kHz to about 40 kHz. The amplitude (e.g., displacement) of the horn 71, and more particularly the terminal end 73 thereof, upon ultrasonic vibration may be varied by adjusting the input power of the power source, with the amplitude generally increasing with increased input power. For example, in one suitable embodiment the input power is in the range of about 0.1 kW to about 4 kW, more suitably in the range of about 0.5 kW to about 2 kW and more suitably about 1.5 kW. In another example, the amplitude (e.g., displacement) of the horn 71 at the terminal end 73 thereof (e.g., at the contact surface 63 of the vibration system 61) is suitably in the range of about 0.0005 to about 0.007 inches.

Figure 2A:
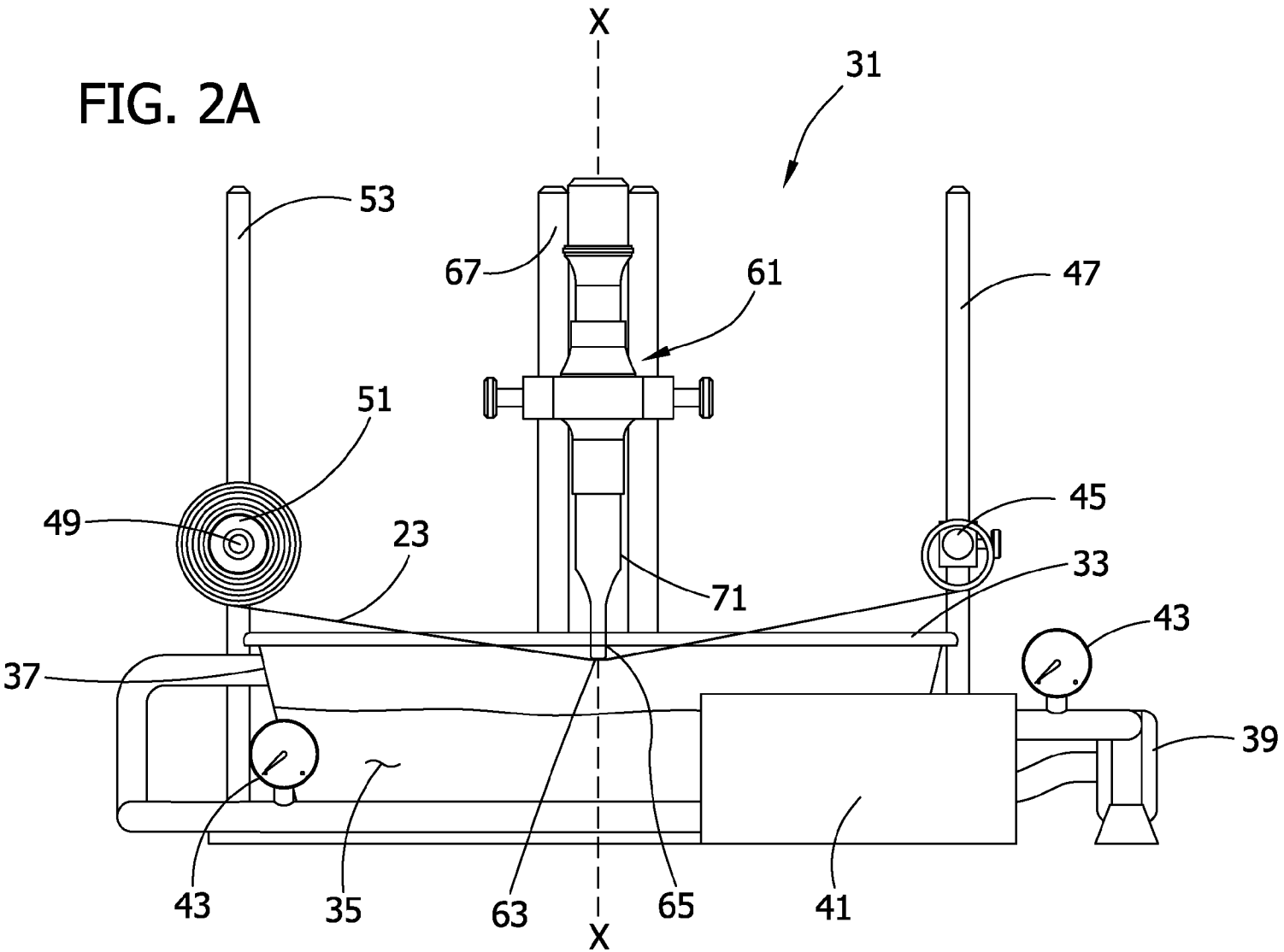
FIG. 2A is a side elevation similar to FIG. 2 with the ultrasonic vibration system illustrated in a withdrawn position of the vibration system.

In operation according to one embodiment of a process for dyeing a textile web, the textile web 23 is dyed at the dyeing station and, if desired, cured at the curing station and then rolled up and transported to and mounted on the unwind roll 45 of the washing station 31. An initial length of the web 23 is unwound from the unwind roll 45 and wound onto the wind roll 49 with the web passing beneath the terminal end 65 of the ultrasonic vibration system 61. At this stage, the ultrasonic vibration system 61 is in its withdrawn position as illustrated in FIG. 2A. The ultrasonic vibration system 61 is then moved (e.g., lowered in the illustrated embodiment of FIG. 2) to its immersed position to move the terminal end 65 (and hence the contact surface 63) of the vibration system, and the segment of the textile web 23 in contact therewith, into the treatment liquid 35 in the holding tank 33. The textile web 23 may also be tensioned upon movement of the vibration system 61 to its immersed position and/or by further winding the wind roll 49, by back winding the unwind roll 45, or both. Positioning of the vibration system 61 in its immersed position also orients the textile web 23 between the unwind and wind rolls 45, 49 to define the approach angle A1 and departure angle B1 of the web relative to the longitudinal axis X of the ultrasonic vibration system.

The textile web 23 is suitably configured between the unwind and wind rolls 45, 49 in what is referred to herein as a generally open configuration. The term "open configuration" is intended to mean that the textile web 23 is generally flat or otherwise unfolded, ungathered and untwisted, at least at the segment of the web in contact with the contact surface 63 of the vibration system 61. The drive mechanism 51 associated with the wind roll 49 is then operated to draw the textile web 23 from the unwind roll 45 into the holding tank 33, and more particularly into the treatment liquid 35, along the approach angle A1. The textile web 23 passes across the contact surface 63 of the ultrasonic vibration system 61, i.e., in contact therewith, in the machined direction of the web and is then further drawn away from the contact surface of the vibration system toward the wind roll 49 along the departure angle B1.

A feed rate of the web 23 (i.e., the rate at which the web moves in the machine direction over the contact surface 63 of the vibration system 61) and the width of the contact surface (i.e., the thickness t of the terminal end 73 of the horn 71 in the illustrated embodiment, or where the contact surface is not flat or planar, the total length of the contact surface from one side of the terminal end of the horn to the opposite side thereof) determine what is referred to herein as the dwell time of the web on the contact surface of the vibration system. It will be understood, then, that the term "dwell time" refers herein to the length of time that a segment of the textile web 23 is in contact with the contact surface 63 of the vibration system 61 as the web is drawn over the contact surface (e.g., the width of the contact surface divided by the feed rate of the web). In one suitable embodiment, the feed rate of the web 23 across the contact surface 63 of the vibration system 61 is in the range of about 0.5 feet/minute to about 2,000 feet/minute, more suitably in the range of about 1 to about 100 feet/minute and even more suitably in the range of about 2 to about 10 feet/minute. It is understood, however, that the feed rate may be other than as set forth above without departing from the scope of this invention.

In other embodiments, the dwell time is suitably in the range of about 0.1 seconds to about 60 seconds, more suitably in the range of about 1 second to about 10 seconds, and even more suitably in the range of about 2 seconds to about 5 seconds. It is understood, however, that the dwell time may be other than as set forth above depending for example on the material from which the web 23 is made, the dye composition, the frequency and vibratory amplitude of the horn 71 of the vibration system 61, the treatment liquid 35 including the composition thereof and the circulation rate of the liquid in the tank 33, and/or other factors, without departing from the scope of this invention.

The treatment liquid 35 within the holding tank 33 is suitably circulated to flow relative to the textile web 23 and ultrasonic vibration system 61, e.g., from the inlet 37 to the outlet in the illustrated embodiment. A flow rate of the treatment liquid 35 within the holding tank 33 is suitably sufficient to maintain a generally clean treatment liquid continuously flowing past the contact surface 63 of the ultrasonic vibration system 61. However, while in some instances it may be less efficient (e.g., at extracting dye away from the textile web 23), it is contemplated that partially contaminated treatment liquid 35 (e.g., with dye removed from the textile web and entrained therein) may flow across the contact surface 63 of the ultrasonic vibration system 61 without departing from the scope of this invention. As an example, in one embodiment the flow rate of treatment liquid 35 within the holding tank is suitably in the range of about 0.1 to about 50 gallons/minute, more suitably in the range of about 0.5 to about 10 gallons/minute, and even more suitably in the range of about 1 to about 5 gallons/minute.

The ultrasonic vibration system 61 is also operated by the power source to ultrasonically vibrate the ultrasonic horn 71 as the web is drawn over the contact surface of the vibration system. The horn 71 imparts ultrasonic energy to the segment of the textile web 23 that is in contact with the contact surface 63 defined by the terminal end 73 of the horn. In one suitable embodiment, where dye is applied at the dyeing station 25 to the textile web 23 generally on only one surface of the web, the web is arranged so that this same surface is opposed to and contacts the contact surface 63 of the ultrasonic vibration system 61 at the washing station 31. Imparting ultrasonic energy to the web 23 at this surface facilitates the migration of unbound dye in the web out toward at least this same web surface and more suitably it has the tendency to migrate out toward both surfaces of the web, for exposure to the flowing treatment liquid 35.

It is understood, however, that the opposite surface of the web 23 (i.e., the surface opposite to that which the dye was initially applied) may oppose and contact the contact surface 63 of the vibration system 61 without departing from the scope of this invention. It is also contemplated that a second ultrasonic vibration system (not shown) may be used to apply ultrasonic energy to the opposite surface of the web, either concurrently or sequentially with the first ultrasonic vibration system 61. In other embodiments, a second holding tank (not shown) may be disposed downstream (e.g., in the machine direction) from the holding tank 33 and comprise a second ultrasonic vibration system (not shown) to impart ultrasonic energy to the surface of the web 23 opposite to the surface contacted by the first ultrasonic vibration system 61.

Unbound dye that is on and/or migrates to the surfaces of the textile web 23 becomes entrained in the flow of treatment liquid 35 and is carried away from the textile web. In the illustrated embodiment, the contaminated treatment liquid then exits the holding tank 33 via the outlet, following which the dye is filtered from the treatment liquid 35 by the filter system 41 and the treatment liquid is re-circulated back to the inlet 37 and through the holding tank. In alternative embodiments, the contaminated treatment liquid that exits the tank may be filtered and directed to a suitable drain, sewage, wastewater or recovery system. Following treatment by the washing station 31, the textile web 23 is removed from the washing station for subsequent processing as desired.

Figure 5:
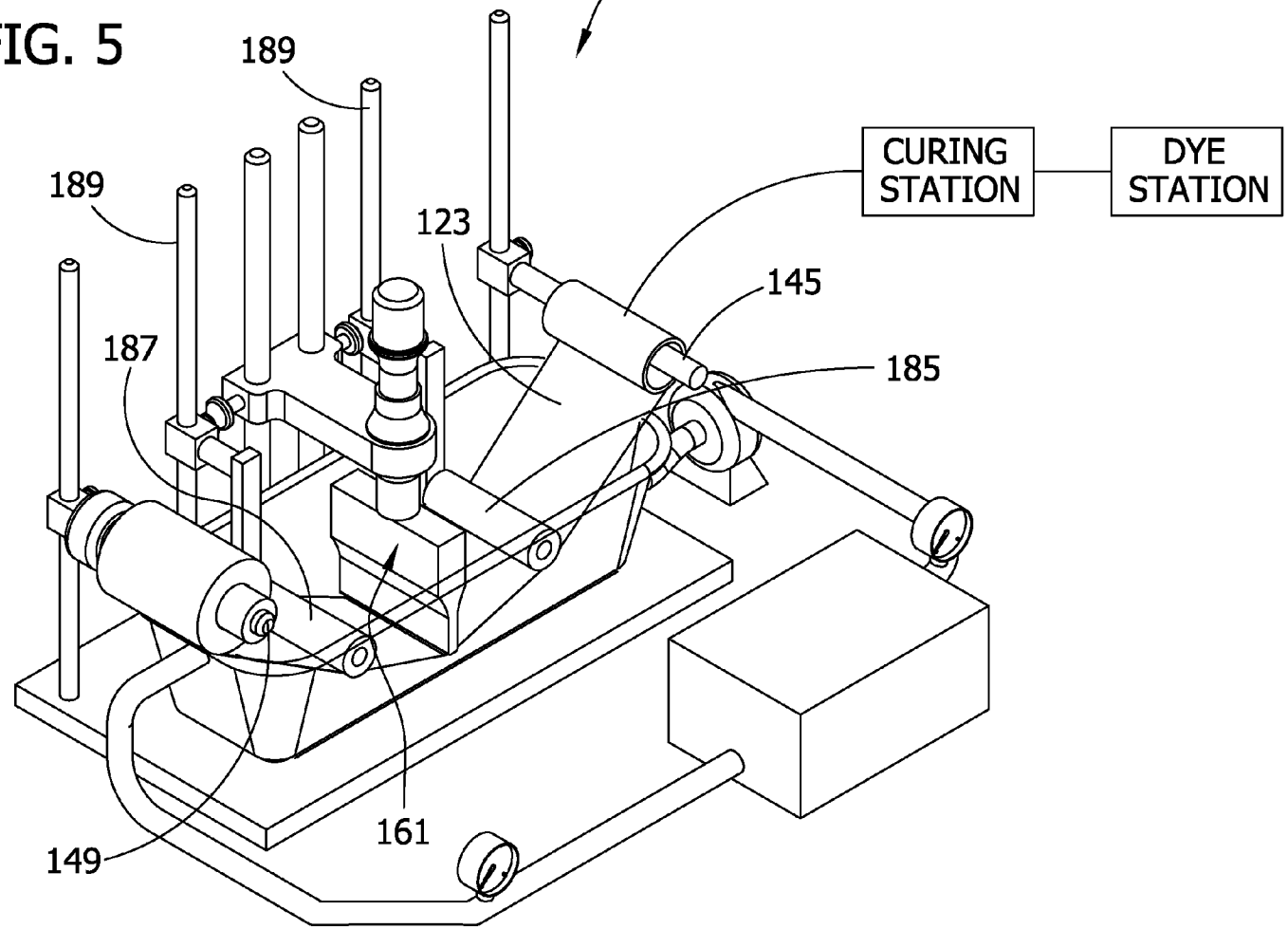
FIG. 5 is a schematic perspective of another embodiment of apparatus for dyeing a textile web according to a process for dyeing a textile web, with an ultrasonic vibration system of the apparatus illustrated in an immersed position of the vibration system.

FIG. 5 illustrates a second embodiment of apparatus, generally indicated at 121, for use in dyeing a textile web 123. The apparatus 121 of this second embodiment is substantially similar to the apparatus 21 of the first embodiment of FIGS. 1 and 2 with the addition of a pair of guide rolls 185, 187 supported by suitable support structure 189 and disposed in spaced relationship with the ultrasonic vibration system 161 in the machine direction of the web 123 between the unwind and wind rolls 145, 149 and on opposite sides of the ultrasonic vibration system. The guide rolls 185, 187 further facilitate tensioning of the textile web 123 to the desired tension and generally maintain proper alignment of the web relative to the ultrasonic vibration system 161 as the web is fed through the treatment liquid in contact with the contact surface of the ultrasonic vibration system.

EXPERIMENT 1

An experiment was run to assess the effectiveness of apparatus constructed in the manner of the apparatus 21 of embodiment of FIGS. 1 and 2 in dyeing a textile web, and more particularly the effectiveness of the washing station 31 of such apparatus to remove unbound dye from a dyed and cured cotton textile web without undesirably removing bound dye from the web. For this experiment, three identically constructed woven cotton web specimens were used. The particular web material used is commercially available from Test Fabrics, Inc. of West Pittston, Pa., U.S.A. as Style No. 419—bleached, mercerized, combed broadcloth. The webs each had a basis weight of about 120 grams per square meter and a weight of about 15.53 grams. Each web specimen was approximately four feet (about 122 cm) in length and four inches (about 10.2 cm) wide.

A dye solution was formed from 10.1 grams of red dichlorotriazine dye (typically referred to as a fiber-reactive dye), commercially available from DyStar Textilfarben GmbH of Germany under the tradename and model number Procion MX-5B, 10.2 grams of sodium carbonate and 1000 grams of water. The solution was poured into an open holding tank. Each web specimen, in rolled form, was placed on an unwind roll and unrolled and drawn continuously through the bath of dye solution (i.e., dip-coated) by a suitable wind roll and drive mechanism at a feed rate of about 4 ft./min. (about 2.03 cm/sec), and then re-rolled at the wind roll. Each rolled, dyed web was then placed in a sealed bag at room temperature for a period of about 12-15 hours to facilitate binding of the dye to the textile web.

The washing station for this experiment comprised a holding tank sufficient to hold at least 500 milliliters of water. The water was not circulated in the tank during testing.

For the ultrasonic vibration system, the various components that were used are commercially available from Dukane Ultrasonics of St. Charles, Ill., U.S.A as the following model numbers: power supply—Model 20A3000; converter—Model 110-3123; booster—Model 2179T; and horn Model 11608A. In particular, the horn had a thickness at its connection end of approximately 1.5 inches (3.81 cm), a thickness at its terminal end of approximately 0.5 inches (1.27 cm), a width of about 6.0 inches (15.24 cm) and a length (e.g., height in the illustrated embodiment) of about 5.5 inches (13.97 cm). The contact surface defined by the terminal end of the horn was flat, resulting in a contact surface length (e.g., approximately equal to the thickness of the horn at its terminal end) of about 0.5 inches (1.27 cm).

For each web specimen to be tested, 500 ml. of clean water at room temperature was poured into the holding tank. The rolled, dyed web specimen was placed on an unwind roll and drawn into and through the water by a suitable wind roll and drive mechanism in a manner similar to that described previously in connection with the washing station of FIGS. 1 and 2, with the web passing through the water approximately 1 inch (about 2.54 cm) below the surface of the water. A uniform tension of approximately 5 lbs was applied to the web (e.g., by holding the web taught between the wind roll and unwind roll during drawing of the web). The feed rate of the web was about 4 ft./min. (about 2.03 cm/sec).

After the first pass of the web through the water, the water was removed from the holding tank. The total amount of water plus dye solution in the removed water was measured. The amount of dye solution removed from the web for this first pass was then calculated as the total amount of water plus dye solution minus 500 ml.

The rolled up sample web, following this first washing, was then hand-washed in a conventional manner in 500 ml of clean water to further removed any unbound dye, if still present, from the textile web. The total amount of water plus dye solution in the water was then measured. The amount of additional dye solution removed from the web was then calculated as the total amount of water plus dye solution minus 500 ml. This hand-washing process was repeated until the water, after washing, was visually clean.

For the first specimen, the pass through the washing station was conducted without any ultrasonic energy applied to the water or to the web. For the second specimen, the ultrasonic vibration system was operated at about 2 kW and vibrated at about 20 kHz, with the web passing through the water in direct contact with the contact surface of the horn of the vibration system, e.g., for a dwell time of about 0.63 seconds. For the third specimen, the ultrasonic vibration system was operated at about 0.5 kW and vibrated at about 20 kHz, with the web passing through the water in direct contact with the contact surface of the horn of the vibration system, e.g., for a dwell time of about 0.63 seconds.

The results for the first and second specimens were as follows (with the last run for each specimen being omitted since substantially no dye solution was removed for the last run):

| | Dye Solution Removed | | | | | |
|---|---|---|---|---|---|---|
| | Wash Station (grams) | Hand Wash (grams) | Hand Wash (grams) | Hand Wash (grams) | Total (grams) | Percent removed by Wash Station |
| Ultrasonics Off | 0.003 | 0.015 | 0.004 | 0.003 | 0.025 | 12 percent |
| Ultrasonics On (2 kw, 20 kHz) | 0.018 | 0.012 | — | — | 0.030 | 60 percent |

Thus, applying ultrasonic energy directly to the web substantially increased the amount of unbound dye solution that could be removed from the web on the first pass through the washing station. However, the total amount of unbound dye removed by using ultrasonics for the first pass was relatively close to the total amount of dye solution removed without ultrasonics. This result, coupled with the amount of unbound dye removed from the web in the first hand wash after subjecting the web to the ultrasonic treatment, indicates that no previously bound dye was unbound and removed from the web by the ultrasonic treatment. The third specimen, run at a lower input power (and therefore a resultant lower horn displacement amplitude) resulted in data substantially similar to the second specimen.

In view of the results of the above experiment, it is contemplated that the textile web may be subjected to one or more additional passes through the washing station to further ultrasonically remove unbound dye from the web. For example, with reference to the washing station 31 illustrated in FIGS. 1-2, the rolled-up web 23 could be removed from the wind roll 49 and placed back on the unwind roll 45 to run the web through the same washing station again. Alternatively, a second holding tank (not shown but substantially the same as holding tank 33) and ultrasonic vibration system (not shown but substantially the same as vibration system 61) may be disposed downstream of the holding tank 33 whereby the web 23 following treatment in the first holding tank is drawn further downstream to the second holding tank for a second ultrasonic treatment to further remove unbound dye from the web.

EXPERIMENT 2

A second experiment was run to assess the effect of applying ultrasonic energy directly to the cotton textile web. For this experiment, two identically constructed woven cotton web specimens were used. The web specimens were of the same construction as the web specimens of Experiment 1. The specimens remained undyed during this second experiment. The washing station for this experiment was identical to the washing station used for Experiment 1.

For each web specimen to be tested, 500 ml. of clean water at room temperature was poured into the holding tank. The rolled web specimen was placed on an unwind roll and drawn into and through the water by a suitable wind roll and drive mechanism, with the web passing through the water approximately 1 inch (about 2.54 cm) below the surface of the water. A uniform tension of approximately 5 lbs was applied to the web (e.g., by holding the web taught between the wind roll and unwind roll during drawing of the web). The feed rate of the web was about 4 ft./min. (about 2.03 cm/sec).

After the first pass of the web through the water, the water was removed from the holding tank and filtered to remove all cotton fibers from the water. The cotton fibers were then dried and weighed to determine the amount of fiber material removed from the web specimen. A new 500 ml. of clean water was poured into the holding tank, the web specimen was placed back onto the unwind roll and again passed through the water. The above process was repeated for a third pass as well.

For the first specimen, the ultrasonic vibration system was operated at about 2 kW and vibrated at about 20 kHz, with the web passing through the water in direct contact with the contact surface of the horn of the vibration system, e.g., for a dwell time of about 0.63 seconds. For the second specimen, the ultrasonic vibration system was operated at about 0.5 kW and vibrated at about 20 kHz (e.g., resulting in a lower amplitude displacement of the horn), with the web passing through the water in direct contact with the contact surface of the horn of the vibration system, e.g., for a dwell time of about 0.63 seconds.

For the first web specimen (e.g., in which the ultrasonic vibration system was operated at a higher input power and hence a higher amplitude), approximately 0.087 grams of cotton fibers were removed from the web in the first pass. For the second web specimen (e.g., in which the ultrasonic vibration system was operated at a lower input power and hence a lower amplitude), only about 0.02 grams of cotton fibers were removed from the web in the first pass. That is, operating the ultrasonic vibration system at the lower input power removed approximately ⅕ the amount of fibers as operating at the higher input power.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A process for dyeing a textile web, said textile web having a first face and a second face opposite the first face, said method comprising:

applying dye to the textile web;

immersing the dyed textile web in a flowing treatment liquid with the textile web in a generally open configuration, the flowing treatment liquid being different from the dye applied to the textile web, said applying step being performed prior to immersing the dyed textile web in the flowing treatment liquid;

immersing a contact surface of an ultrasonic vibration system in said flowing treatment liquid with said contact surface in direct contact with at least a portion of the textile web immersed in the treatment liquid; and operating the ultrasonic vibration system to impart ultrasonic energy to said portion of the textile web immersed in the treatment liquid at said contact surface of the ultrasonic vibration system to facilitate the removal of unbound dye from the textile web for entrainment in the flow of treatment liquid.

2. The process set forth in claim 1 wherein the step of applying dye to the textile web comprises applying dye to the first face of the textile web, the step of immersing a contact surface of an ultrasonic vibration system in said flowing treatment liquid comprising immersing the contact surface of said ultrasonic vibration system in the flowing treatment liquid with the contact surface in direct contact with one of said first face and said second face of the textile web.

3. The process set forth in claim 2 wherein the step of immersing a contact surface of an ultrasonic vibration system in said flowing treatment liquid comprises immersing the contact surface of said ultrasonic vibration system in the flowing treatment liquid with the contact surface in direct contact with the first face of the textile web.

4. The process set forth in claim 1 wherein the step of immersing the dyed textile web in a flowing treatment liquid comprises moving the web in a machine direction thereof within the flowing treatment liquid.

5. The process set forth in claim 4 wherein the treatment liquid flows in a flow direction, the step of moving the web in a machine direction comprising moving the web in a machine direction other than in the flow direction of the flowing treatment liquid.

6. The process set forth in claim 4 wherein the step of moving the web in a machine direction comprises moving the web in a machine direction opposite the flow direction of the flowing treatment liquid.

7. The process set forth in claim 1 wherein the step of immersing the dyed textile web in a flowing treatment liquid comprises moving the web in a machine direction thereof from a upstream location at which the textile web is disposed out of the flowing treatment liquid to a position within the flowing treatment liquid in direct contact with the contact surface of the ultrasonic vibration system, said process further comprising moving the web in a machine direction to a downstream position out of the flowing treatment liquid.

8. The process set forth in claim 7 wherein the ultrasonic vibration system has a longitudinal axis, the textile web being moved from said upstream location to said position in direct contact with the contact surface of the ultrasonic vibration system generally along an approach angle relative to said longitudinal axis of the ultrasonic vibration system, said approach angle being in the range of about 1 to about 89 degrees.

9. The process set forth in claim 8 wherein the approach angle is in the range of about 10 to about 45 degrees.

10. The process set forth in claim 8 wherein the textile web is moved from said position in direct contact with the contact surface of the ultrasonic vibration system to said downstream position along a departure angle relative to said longitudinal axis of the ultrasonic vibration system, said departure angle being in the range of about 1 to about 89 degrees.

11. The process set forth in claim 10 wherein the departure angle is substantially equal to the approach angle.

12. The process set forth in claim 1 wherein the textile web has a width, the process further comprising holding the textile web in uniform tension across the width of the textile web at least at the portion of said textile web in direct contact with the contact surface of the ultrasonic vibration system, said tension being in the range of about 0.05 to about 3 pounds per inch width of said textile web.

13. The process set forth in claim 1 wherein the ultrasonic vibration system is vibrated at a frequency in the range of about 20 kHz to about 40 kHz.

14. The process set forth in claim 1 wherein the ultrasonic vibration system has a displacement amplitude at the contact surface upon vibration thereof, said amplitude being in the range of about 0.0005 to about 0.007 inches.

15. The process set forth in claim 1 wherein the step of operating the ultrasonic vibration system comprises supplying a power input to said system, the power input being in the range of about 0.5 kW to about 2 kw.

16. The process set forth in claim 1 wherein the textile web has a width, the ultrasonic vibration system comprising an ultrasonic horn having a terminal end defining said contact surface, said terminal end of the ultrasonic horn having a width that is approximately equal to or greater than the width of the web, said step of immersing a contact surface of an ultrasonic vibration system in said flowing treatment liquid with said contact surface in direct contact with at least a portion of the textile web immersed in the treatment liquid comprising orienting the ultrasonic horn such that the terminal end of the horn extends widthwise across the width of the web with the contact surface in direct contact with the web.

17. The process set forth in claim 16 wherein the ultrasonic horn is of unitary construction to extend continuously at least along its width at said terminal end of the ultrasonic horn.

18. A process for dyeing a textile web, said textile web having a first face and a second face opposite the first face, said method comprising:

applying dye to the textile web;

directing the textile web into a holding tank containing a treatment liquid with the textile web being immersed in the treatment liquid, the flowing treatment liquid being different from the dye applied to the textile web, said applying step being performed prior to immersing the dyed textile web in the flowing treatment liquid;

flowing the treatment liquid within the holding tank from an inlet of the tank at which the treatment liquid enters the tank to an outlet of the tank at which the treatment liquid exits the tank;

immersing a contact surface of an ultrasonic vibration system in said treatment liquid within the tank with said contact surface in direct contact with at least a portion of the textile web immersed in the treatment liquid;

operating the ultrasonic vibration system to impart ultrasonic energy to said portion of the textile web immersed in the treatment liquid at said contact surface of the ultrasonic vibration system to facilitate the removal of unbound dye from the textile web for entrainment in the flow of treatment liquid; and filtering dye from the treatment liquid after the treatment liquid exits the holding tank.

19. The process set forth in claim 18 further comprising re-circulating treatment liquid back to the inlet of the holding tank after filtering dye from the treatment liquid.

20. The process set forth in claim 18 wherein the step of applying dye to the textile web comprises applying dye to the first face of the textile web, the step of immersing a contact surface of an ultrasonic vibration system in said flowing treatment liquid comprising immersing the contact surface of said ultrasonic vibration system in the flowing treatment liquid with the contact surface in direct contact with one of said first face and said second face of the textile web.

21. The process set forth in claim 20 wherein the step of immersing a contact surface of an ultrasonic vibration system in said flowing treatment liquid comprises immersing the contact surface of said ultrasonic vibration system in the flowing treatment liquid with the contact surface in direct contact with the first face of the textile web.

* * * * *